US012207680B2

(12) United States Patent
Franklin

(10) Patent No.: US 12,207,680 B2
(45) **Date of Patent: *Jan. 28, 2025**

(54) WATER PIPE WITH INTEGRATED LIGHTER RECEPTACLE

(71) Applicant: Howard Franklin, Vancouver (CA)

(72) Inventor: Howard Franklin, Vancouver (CA)

( * ) Notice: Subject to any disclaimer, the term of this patent is extended or adjusted under 35 U.S.C. 154(b) by 29 days.

This patent is subject to a terminal disclaimer.

(21) Appl. No.: 17/704,432

(22) Filed: Mar. 25, 2022

(65) Prior Publication Data

US 2022/0211099 A1 Jul. 7, 2022

Related U.S. Application Data

(63) Continuation of application No. 16/349,346, filed as application No. PCT/IB2018/000803 on Jun. 26, 2018, now Pat. No. 11,304,445.

(60) Provisional application No. 62/524,772, filed on Jun. 26, 2017.

(51) Int. Cl.

| | |
|---|---|
| ***A24F 1/30*** | (2006.01) |
| ***A24F 3/00*** | (2006.01) |
| ***A24F 21/00*** | (2006.01) |

(52) U.S. Cl.

CPC ..... *A24F 1/30* (2013.01); *A24F 3/00* (2013.01); *A24F 21/00* (2013.01)

(58) Field of Classification Search

None

See application file for complete search history.

(56) References Cited

U.S. PATENT DOCUMENTS

| | | | | |
|---|---|---|---|---|
| 3,889,690 | A | 6/1975 | Guarnieri | |
| 4,595,905 | A | 6/1986 | May | |
| 10,499,687 | B1 | 12/2019 | Cook | |
| 2010/0319716 | A1 | 12/2010 | Tao | |
| 2012/0315588 | A1* | 12/2012 | Kondrat | F23Q 2/44 431/317 |
| 2018/0220701 | A1 | 8/2018 | Risolia et al. | |

FOREIGN PATENT DOCUMENTS

| | | | |
|---|---|---|---|
| CN | 2785384 | Y | 6/2006 |

OTHER PUBLICATIONS

International Searching Authority, Search Report and Written Opinion issued in International Patent Application No. PCT/IB2018/000803 mailed Oct. 30, 2018 (10 pages).

Piecemaker Gear, "Big Kahuna," Facebook post of Apr. 30, 2017, <https://www.facebook.com/piecemakergear/photos/a.1480857082208545/1694958190798432/?type=3&theater> 1 page.

* cited by examiner

*Primary Examiner* — Katherine A Will

(74) *Attorney, Agent, or Firm* — Wood Herron & Evans LLP

(57) ABSTRACT

A water pipe is provided with an integrated lighter receptacle to reliably retain a handheld lighter in a convenient location. The water pipe includes a basin with a chamber pipe extending upwardly from the basin and a bowl configured to hold a smoking material. The lighter receptacle is proximate to the basin and retains the handheld lighter in position proximate the bowl so that smoking material in the bowl can be ignited when necessary during a smoking use. The interior of the lighter receptacle is sized to receive a portion of the handheld lighter. Thus, the additional equipment used when smoking with a water pipe are not misplaced or lost during smoking.

16 Claims, 5 Drawing Sheets

WATER PIPE WITH INTEGRATED LIGHTER RECEPTACLE

CROSS-REFERENCE TO RELATED APPLICATION

This application is a continuation of U.S. patent application Ser. No. 16/349,346, filed May 13, 2019 which is a national phase application and claims priority to International Application No. IB2018/000803, filed Jun. 26, 2018 which claims priority to U.S. Provisional Application No. 62/524,772, filed Jun. 26, 2017, the disclosures of which are incorporated by reference herein in their entireties.

TECHNICAL FIELD

This invention relates generally to smoking devices used for smoking combustibles, and more specifically, to water pipes and associated equipment used for recreational or medicinal smoking.

BACKGROUND

In smoking devices, such as water pipes, it is necessary to keep several ingredients or ancillary equipment on hand to complete and enjoy the process of smoking a combustible. For example, the combustible material (like forms of tobacco or the like), a fluid, such as water, and/or ice, may need to be available to fill the components of a conventional water pipe before use. Likewise, additional equipment may be used in conjunction with the water pipe such as grinders for preparing the smoking material, lighters for igniting the smoking material when placed in a bowl of the water pipe, and a towel for wiping clean the mouthpiece of the water pipe between uses. Other equipment and materials may also be used depending on the preferences of the user of the water pipe.

Of all the equipment needed for use of a water pipe, the lighter or a similar equivalent such as a lighting hemp wick is needed most often, as the smoking material in the bowl must be ignited for each inhalation of smoke to be taken from the water pipe. However, conventional handheld lighters such as BIC® lighters are small and often easily misplaced when working with all the other ingredients and equipment needed to enjoy smoking with a water pipe. Accordingly, a need exists for a convenient way to store a handheld lighter while using a smoking device such as a water pipe to enable enjoyable smoking experiences without the fear of misplacing or dropping the lighter between uses.

Several conventional smoking devices have been developed with lighter holders to address these concerns. However, many of these conventional designs include added external elements such as clamps and fabric retaining loops on the portions of the smoking device often held by a user during smoking use (e.g., such as on the chamber pipe of a water pipe). These external elements can interfere with a user's grip on the smoking device and/or be knocked off during normal use of the smoking device, and they often detract significantly from the aesthetic design of the smoking device. Considering many water pipes and similar smoking devices are designed just as much for artistic appearance as smoking functionality, these conventional lighter holder designs are not preferred by consumers in this market. Likewise, the failure to securely retain the handheld lighter to avoid accidental dislodgements and the like, results in these conventional designs not being adequate for their intended purpose. Further improvements are desired, particularly in the field of water pipes.

SUMMARY

The apparatus and methods disclosed herein address the above stated needs for storing a handheld lighter between uses in the field of water pipes. In one embodiment, the water pipe comprises a basin with an internal cavity, a chamber pipe, a mouthpiece, a bowl, and a lighter receptacle. The chamber pipe is in fluid communication with and extending upwardly from the basin to the mouthpiece. The bowl is mounted on a bowl stem that is configured to removably engage a downstem that is configured to removably engage a downstem receptacle through an aperture on a peripheral side of the basin. The lighter receptacle is located in a fixed position on a peripheral side of the basin and configured to extend into the internal cavity of the basin. The lighter receptacle can be formed integrally as a unitary piece with the basin or, the receptacle can be formed as a separate assembly from the basin. The lighter receptacle formed as a separate assembly from the basin is removably engaged with the basin through an aperture formed on a peripheral surface of the basin. The apparatus as disclosed above, provides a convenient and accessible storage location for the lighter on the water pipe, especially for accessing and storing the lighter while using the water pipe.

In one aspect, the basin of the water pipe is configured to render the water pipe free standing. In another aspect, the lighter receptacle is sized to produce a frictional or interference fit with the handheld lighter for purposes of securely storing the lighter between uses. In some embodiments, the lighter receptacle is oriented to position the lighter at an angle of between 30 to 90 degrees from the horizontal bottom surface of the basin, or for example, at an angle of 70 degrees to optimize the user's accessibility to the lighter. In another embodiment, the downstem receptacle is formed integrally as a unitary piece on a peripheral surface of the basin. In one aspect, the lighter receptacle is located 90 degrees of rotation or less around the peripheral surface of the basin from the downstem receptacle and bowl to optimize the user's access to the lighter receptacle to store or retrieve the lighter, especially while using the water pipe. In some embodiments, the lighter receptacle also includes a removable dampening member to prevent damage to the lighter receptacle during removal and storage of the lighter.

The user removes the handheld lighter from the lighter receptacle and uses the lighter to ignite the combustible material in the bowl. Upon lighting the combustible material in the bowl, the user engages the mouthpiece to collect and remove the smoke from the combustion of material in the bowl. After the user has finished using the lighter, the user secures the lighter in the lighter receptacle for future use. This process may be repeated each time the user repeats the smoking cycle.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Embodiments of the invention are directed to smoking devices such as water pipes, and in particular, smoking devices including an integrated lighter receptacle or holder that can be used to reliably retain a handheld lighter between uses of the lighter to ignite combustible materials in the smoking device. To this end, in a preferred embodiment, the integrated lighter receptacle is formed integrally as a unitary piece with the remainder of the water pipe, and the lighter receptacle is sized to receive, preferably by means of a frictional or interference fit, a conventional handheld lighter to prevent any potential accidental dislodgements or dropping of the handheld lighter. The integrated lighter receptacle is joined to the water pipe at a location that does not negatively detract from the aesthetic appearance of the water pipe, and this location also is not a typical gripping location for a user during a smoking operation, such that the lighter receptacle does not interfere with normal use of the water pipe. By allowing for reliable retention of a handheld lighter on the body of the water pipe itself and close to the position the lighter is used, problems with misplaced or missing lighters can be avoided, thereby resulting in a more relaxing and enjoyable smoking experience.

Moreover, before explaining the embodiments of the water pipe 1 of this invention, it is to be understood that this smoking device is not limited to the particular embodiments shown. For example, several specific variations and alternatives are also described in connection with the embodiments below.

Figure 1:
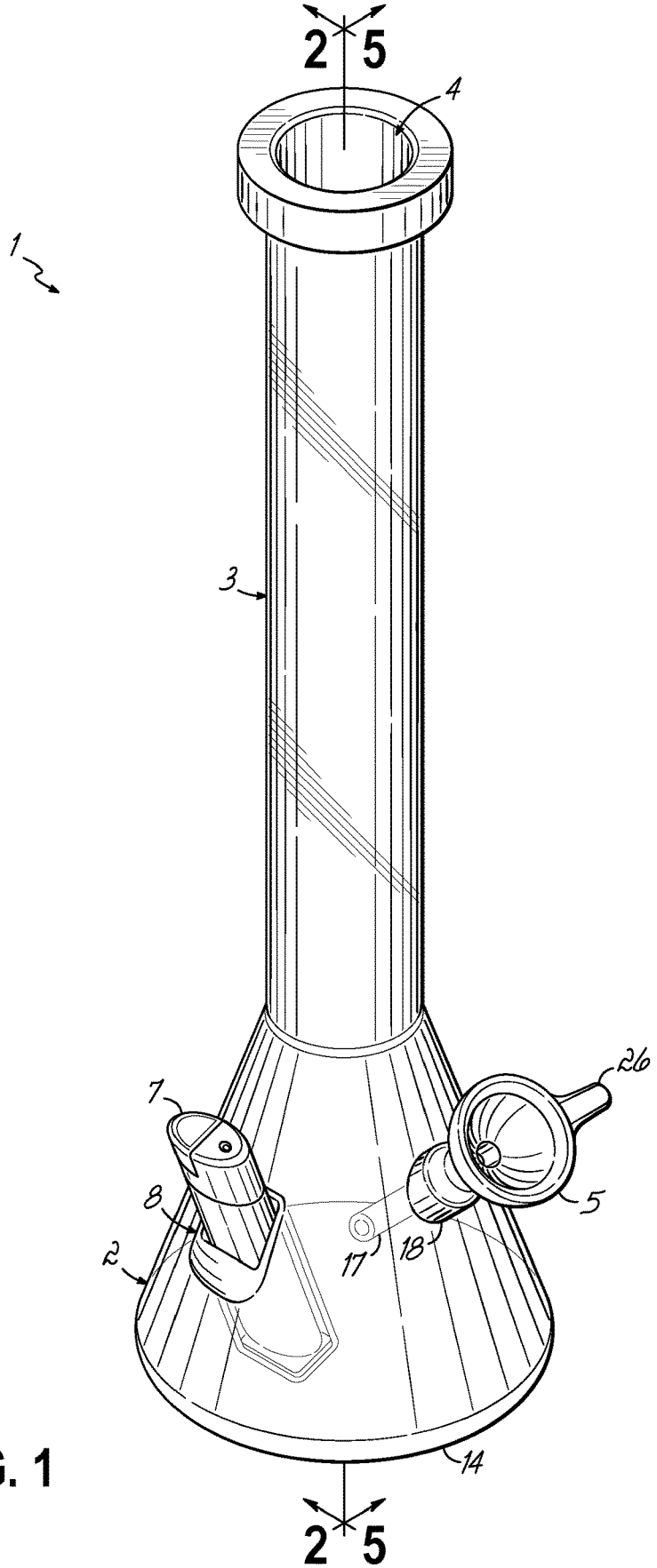
FIG. 1 is a top front perspective view of a water pipe with an integrated lighter receptacle, in accordance with one embodiment of the present invention, the lighter receptacle shown as filled by a handheld lighter.

FIGS. 1 through 5 illustrate an exemplary embodiment of a water pipe 1 having an integrated lighter receptacle 8. As shown in FIG. 1, the water pipe 1 includes a basin 2 connected to an elongate chamber pipe 3 with an opening defining a mouthpiece 4 at the top end opposite the basin 2. The mouthpiece 4 is formed as an enlarged portion of the chamber pipe 3 in this embodiment. The basin 2 is configured to be partially filled with a liquid, such as water, in an internal cavity 32 which defines a volume thereof. In this embodiment, the basin 2 is shown to be generally conical in shape, so as to expand in cross section from the bottom end of the chamber pipe 3 to a generally flat bottom surface 14 defining a support or base for the water pipe 1. The chamber pipe 3 is generally cylindrical in this embodiment. It will be understood that the basin 2 and the chamber pipe 3 may be formed with a different profile or shape in other embodiments (including but not limited to having the chamber pipe 3 extend upwardly at an angle rather than vertically), without departing from the scope of this invention. The basin 2 may include interior features (not shown in detail) for collecting or controlling condensation or movement of water and smoke within the water pipe 1, as will be readily understood by those skilled in the smoking field.

The water pipe 1 also includes a small bowl 5 (also colloquially referred to as a "slide") that is mounted on an elongate bowl stem 6 configured to be removably inserted into a downstem 17, and the downstem 17 is configured to be removably inserted into the basin 2. The basin 2 includes an aperture 16 formed in a sidewall of the basin 2 or in a downstem receptacle 18 formed at the basin 2, the latter arrangement being shown in the exemplary embodiment of FIGS. 1 and 5. In some embodiments, the bowl stem 6 itself is of a length to extend into water contained within the basin 2 without the need for a downstem 17, while in other embodiments, and as shown in FIG. 5, the downstem 17 defines a tube-like structure that communicates between the water in the basin 2 and the lower end of the bowl stem 6. The bowl stem 6 and bowl 5 are sized to produce a glass-on-glass fluid-tight seal, such as a hermetic seal, when inserted into the downstem 17, and the downstem 17 is sized to produce a glass-on-glass fluid-tight seal, such as a hermetic seal, when inserted into the basin 2 via the aperture 16, thereby preventing air flow leaks out of the basin 2 during smoking use (except via the flow path defined through the tube of the bowl 5 and bowl stem 6). The engagements may also be coated with or formed from heat resistant material or include grommets to avoid heat transfer stresses/fractures that may otherwise be caused by the ignition of smoking material in the bowl 5. The bowl 5 is configured to hold smoking material to be combusted, with ignition typically caused by use of a handheld lighter 7, which is commonly supplied separately from the water pipe 1. Although not shown in FIGS. 1 through 5, some embodiments of the water pipe 1 may include an additional aperture in the sidewall of the basin 2 referred to as a "carb" for selectively allowing venting between the air space in the internal cavity 32 of the basin 2 and the exterior environment during smoking use. Each of these components of the water pipe 1 may be formed from glass or silicone material as shown, but other types of smoking device materials can also be used without departing from the scope of this invention.

As thoroughly understood in the smoking field, the water pipe 1 is used as follows. The basin 2 is partially filled with a fluid, such as water, at least to an extent which will cover the bottom end of the downstem 17 (or the bowl stem 6). The bowl 5 is lightly packed with smoking material such as tobacco products or the like, and then the bowl stem 6 and bowl 5 are inserted into the downstem 17 which is seated through the aperture 16 and into the downstem receptacle 18 to create a fluid-tight seal, such as a hermetic seal, with the basin 2. The bowl 5, bowl stem 6, and downstem 17 define an air flow path from the open top end (at bowl 5) to the bottom end of the downstem 17, which is located underneath the fluid level in the basin 2. The lighter 7 is then used to ignite the smoking material in the bowl 5 while a user places his or her mouth on the mouthpiece 4 and inhales to draw air (and smoke) from the combusting smoking material through the bowl stem 6 and downstem 17 and water into the chamber pipe 3, e.g., the user creates negative pressure within the interior of the water pipe 1. Once the chamber pipe 3 is sufficiently filled with smoke, the bowl 5 can be lifted out (or the optional "carb" opened) of the downstem 17 while continuing to inhale to pull in the collected smoke from the chamber pipe 3 into the user's mouth. The bowl 5 includes a handle 26 for such movement, for example. The process can then be repeated until the smoking material is depleted and needs to be replaced.

As can be understood from the description of a typical use of the water pipe 1 above, the handheld lighter 7 is needed for a few seconds during the process to ignite the smoking material in the bowl 5, but then is not needed again until another smoking cycle is performed. The user typically holds the water pipe 1 in one hand (often at the chamber pipe 3) while performing the lighting and movement of the bowl 5 with the other hand. As such, the manipulation or storage of the lighter 7 before and after it is used raises difficulties that negatively impact the smoking experience when using conventional water pipes. The preferred embodiment of the water pipe 1 addresses these concerns and difficulties by providing the integrated lighter receptacle 8.

Figure 3:
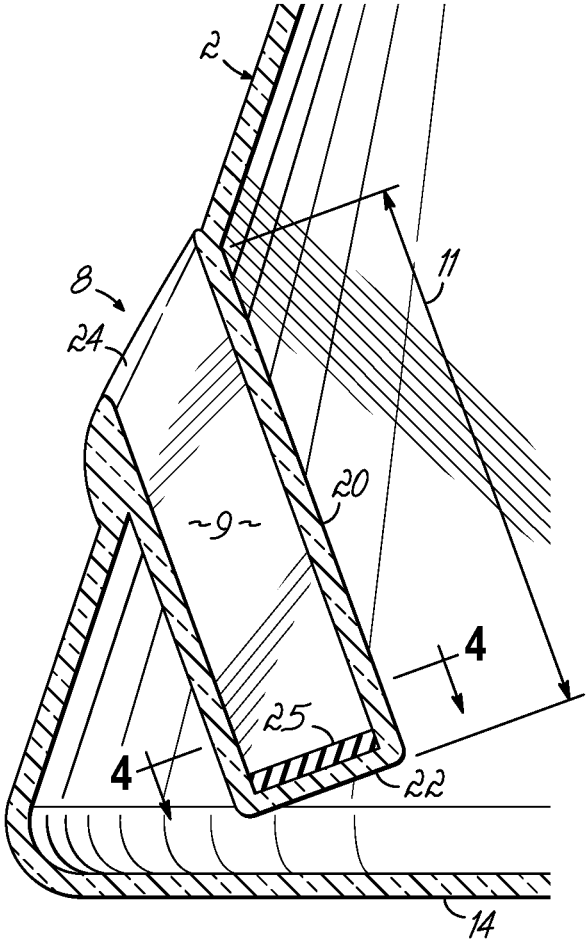
FIG. 3 is a detailed cross-sectional view of a lower portion of the water pipe of FIG. 2, with the handheld lighter removed from the lighter receptacle.
Figure 4:
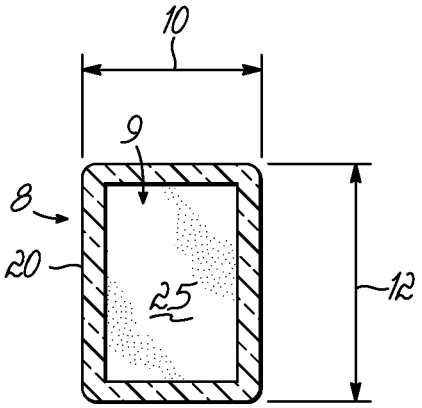
FIG. 4 is a top cross-sectional view of the lighter receptacle of the water pipe of FIG. 3, taken along line 4-4, to show exemplary dimensions for one embodiment thereof.
Figure 5:
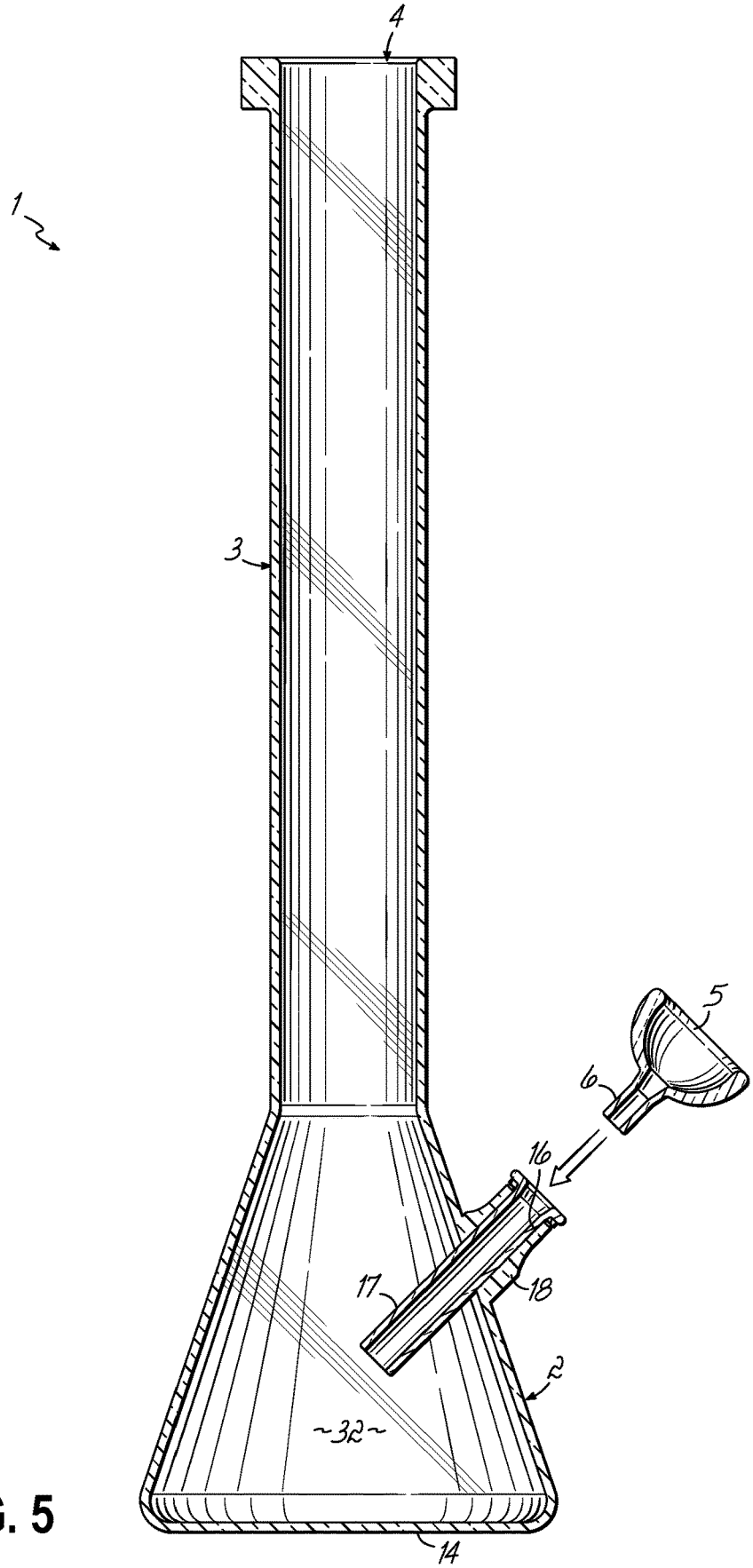
FIG. 5 is a side elevational and cross-sectional view of the water pipe of FIG. 1, taken along line 5-5, showing additional features of the bowl, the downstem and the downstem receptacle.

The lighter receptacle 8 is shown in further detail in FIGS. 3 and 4. The lighter receptacle 8 is integrated with the water pipe 1 at the basin 2 to provide a convenient location for reliably holding the handheld lighter 7 when it is not being used to ignite the smoking material within the bowl 5. To this end, the handheld lighter 7 is retained in a location proximate to the bowl 5 so that a user can quickly and easily retrieve the lighter 7 and replace it within the receptacle 8 when finished with the lighter 7. The lighter receptacle 8 is located in the illustrated embodiment about 90 degrees around the circumference of the basin 2 from the bowl 5, although this spacing may be modified in other embodiments. The preferred location of 90 degrees around the circumference of the basin 2 from the bowl 5 provides a convenient and accessible storage location for the lighter 7, especially for accessing and storing the lighter 7 while using the water pipe 1.

With continued reference to FIGS. 3 and 4, the lighter receptacle 8 includes an interior 9 defined by a sidewall 20 and a closed bottom wall 22. The interior 9 of this embodiment is sized to receive (potentially in a frictional fit) 50% or at least half of a conventional handheld lighter 7, shown in these Figures as a BIC® lighter. It will be appreciated that other types of conventional lighters (torch lighters, etc.) may be used with water pipes 1, and the size and shape of the interior 9 can be reconfigured in other embodiments to receive those other types of known lighters 7. The lighter receptacle 8 includes an opening 24 at a top end opposite the closed bottom wall 22, and the handheld lighter 7 is inserted into and removed from the interior 9 via this opening 24.

Figure 2:
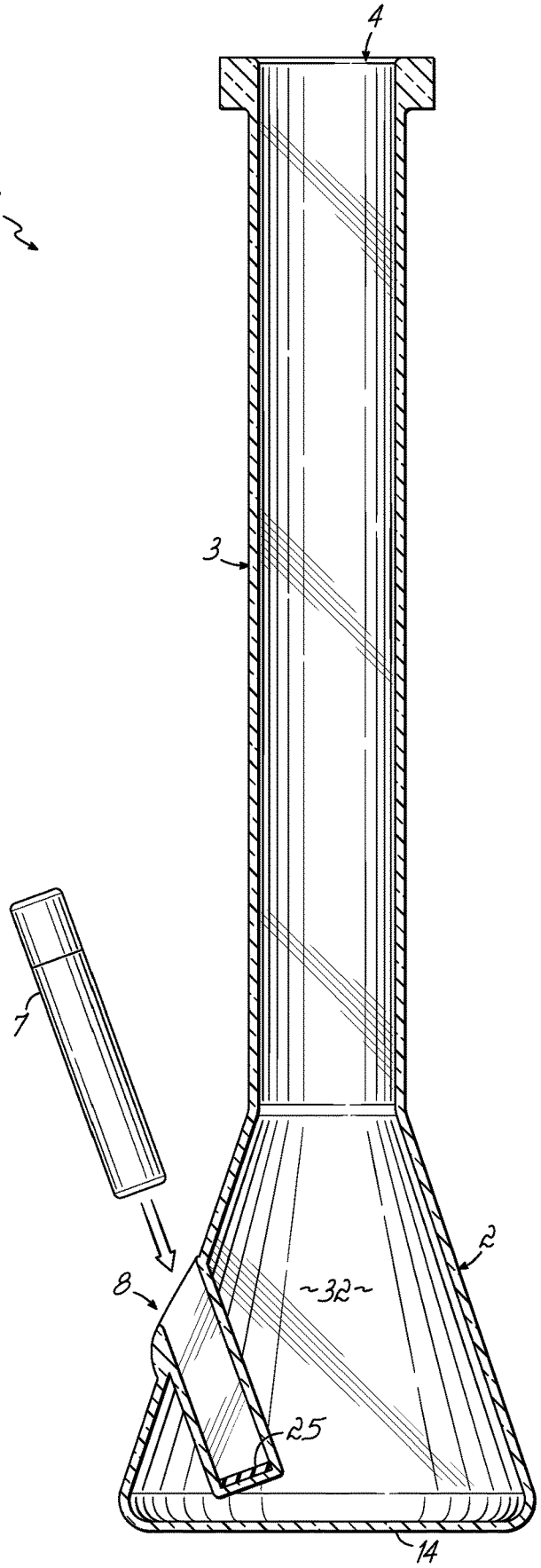
FIG. 2 is a front elevational and cross-sectional view of the water pipe of FIG. 1, taken along line 2-2, showing additional features of the integrated lighter receptacle.

The lighter receptacle 8 of the embodiment shown in FIGS. 1 through 3 is formed integrally as a unitary piece with the basin 2, and therefore is not removable in this embodiment. These types of embodiments are advantageous for some consumers because there are less junctions to seal closed at the basin 2 and fewer parts to keep track of in the water pipe 1. However, in other embodiments it may be desired to enable removal of this element for deep cleaning the basin 2 and the lighter receptacle 28, and in such alternative embodiments, the receptacle 28 is affixed in position at an aperture 30 formed in the basin 2 to produce the configuration shown in the embodiment of FIG. 6. It will be understood that the removable affixing or securement of the receptacle 28 may be done in different manners, so long as the connection forms a fluid-tight seal to prevent air leaks or water leaks at the junction of the basin 2 and the receptacle 28. These issues are avoided entirely when forming the lighter receptacle 8 as a unitary piece with the basin 2.

Regardless of the construction of these elements of the water pipe 1, the interior 9 of the receptacle 8, 28 remains isolated from the interior of the basin 2 so that air and water does not leak out of the interior of the water pipe 1, and such that the handheld lighter 7 is not exposed to the water. The lighter receptacle 8, 28 does not move relative to the basin 2 when these elements are integrated together at the water pipe 1. The extension of the receptacle 8, 28 into the internal cavity 32 of the basin 2 allows a large portion of the lighter 7 to be disposed within the peripheral defined by the basin 2 and out of the way of a user's hands when the lighter 7 is not needed for use. For example, the interior 9 of the lighter receptacle 8, 28 is sized to receive at least 50% (or half) of the volume of the lighter 7 in this embodiment. In addition to holding a substantial portion of the lighter 7 out of the way of the user during storage, this sizing of the receptacle 8, 28 assures secure retention of the lighter 7 without dislodgement even if the lighter 7 is accidentally bumped by a user's hands during smoking use. Thus, unlike conventional external clamp designs, the lighter 7 will reliably remain in the desired position on the basin 2, ready for use when the smoking material in bowl 5 is to be ignited.

Figure 6:
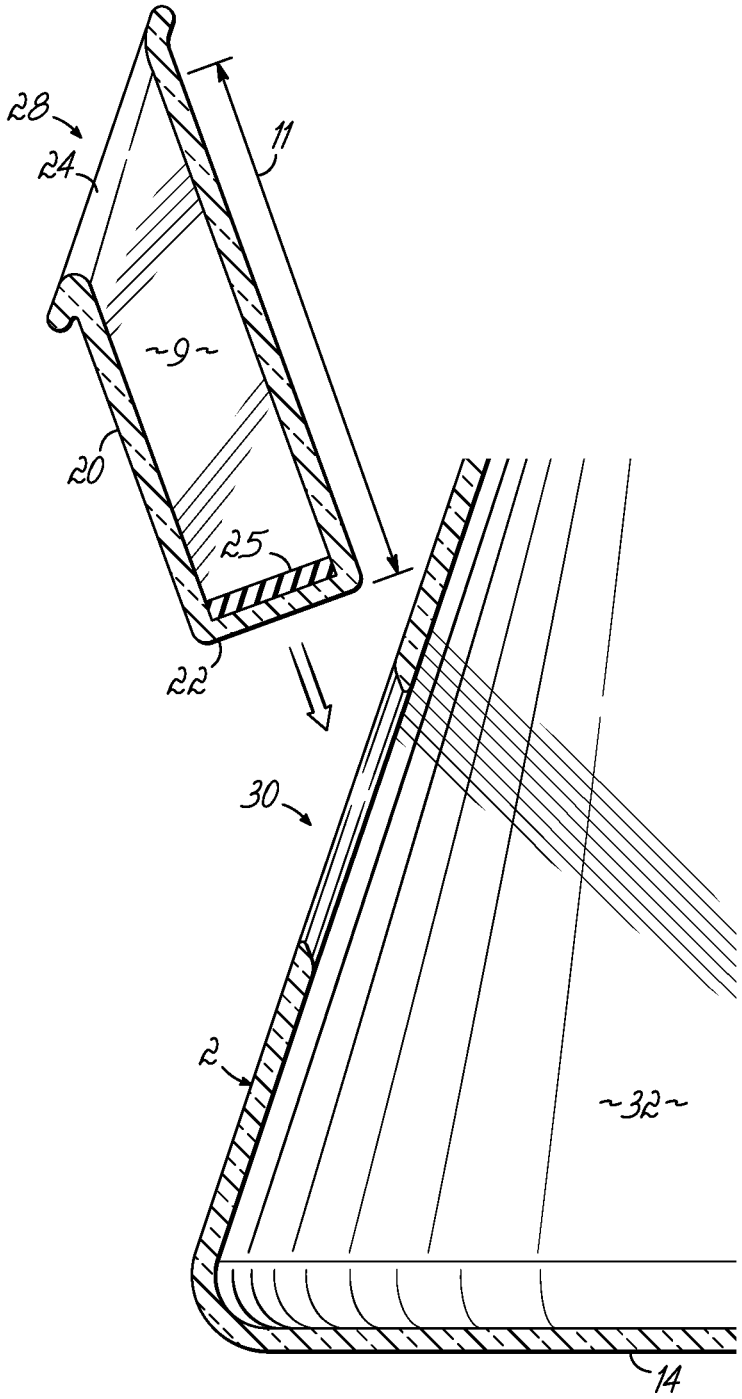
FIG. 6 is a front elevational view of another embodiment of a water pipe in accordance with the invention, showing features including a removable lighter receptacle.

With reference to FIG. 6, the lighter receptacle 28 is shown separated from the water pipe 1. As set forth above, in embodiments with a removable lighter receptacle 28, this would represent what that element would look like when removed from the basin 2. Dimensions for the width 10, depth 11, and length 12 of the lighter receptacle 28, as demonstrated in the exemplary embodiments shown in FIGS. 4 and 6, are tailored to allow the interior 9 to receive at least half of a conventional BIC® lighter. The width 10 is about 20 millimeters, the depth 11 is about 67 millimeters, and the length 12 is about 30 millimeters. It will be appreciated that these dimensions and the overall shape defined by the sidewall 20 and the closed bottom wall 22 may be modified as set forth above to be configured to retain different styles of conventional lighters. The lighter receptacle 8, 28 is typically formed from the same glass or silicone material as the basin 2 as shown in these FIGS. 1 through 6, but it will be understood that when the lighter receptacle 28 is removable, it could also be formed from another type of material without departing from the scope of the invention.

FIGS. 1 through 3 illustrate the water pipe 1 and lighter receptacle 8 of the exemplary embodiment described above, but in a front view. To this end, the total height of the water pipe 1 measured between the mouthpiece 4 and the flat bottom surface 14 should be about 293 millimeters in this embodiment, with the basin 2 defining about 108 millimeters of that height. The chamber pipe 3 has a diameter of about 44 millimeters, while the enlarged mouthpiece 4 is about 14 millimeters in height with about a 59-millimeter outer diameter. The total width or diameter of the basin 2 at the flat bottom surface 14 is about 115 millimeters. The lighter receptacle 8, 28 is oriented to extend into the internal cavity 32 of the basin 2 to position the handheld lighter 7 at an angle of between 0 to 90 degrees from horizontal, or more preferably from 30 to 90 degrees from horizontal, or for example, 70 degrees as shown in these embodiments. This orientation of the lighter receptacle 8, 28 also tends to reliably retain the lighter 7 within the receptacle 8, 28, thanks to the effects of gravity when the water pipe 1 is held in the normal, upright position for smoking. Additionally, storing the lighter 7 at an angle from the horizontal positions the lighter in a way that is convenient and accessible for the user of the water pipe 1 to access, especially while smoking. FIG. 1 also shows about 30% of the lighter 7 extending outside the receptacle 8, 28 during storage of the lighter 7. It will be understood that the dimensions set forth above, may be modified in other embodiments of the water pipe 1, as this is just one exemplary embodiment of a water pipe 1 including an integrated lighter receptacle 8.

As shown in FIGS. 3 and 6, the lighter receptacle 8, 28 contains a removable dampening member 25, configured to fit along the interior surface of the bottom wall 22 of the lighter receptacle. In these preferred embodiments, the dampening member 25 is provided to absorb and dampen energy and shock to the lighter receptacle 8, 28 during storage and removal of the lighter 7 by the user. The dampening member is removable to enhance the cleanability of both the dampening member 25 and lighter receptacle 8, 28. The dampening member 25 can be constructed from silicone or any other suitable material for the application.

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A water pipe comprising:

a basin having an internal cavity;

a chamber pipe in fluid communication and extending upwardly from the basin to a mouthpiece, the mouthpiece being in communication with the internal cavity of the basin;

a bowl configured to hold a combustible material and mounted on a bowl stem that is removably engaged with at least one of a downstem and a downstem receptacle on a side of the basin; and a lighter receptacle proximate to the basin and fixed in position relative to the basin, wherein the lighter receptacle includes a rigid and seamless interior defined by a sidewall and a closed bottom wall, and the lighter receptacle retains a handheld lighter for storage at the water pipe in a location proximate to the bowl, wherein the interior of the lighter receptacle is sized to receive at least a portion of the handheld lighter, wherein the lighter receptacle is integrated with the basin and extends into the internal cavity of the basin, but such that the interior of the lighter receptacle does not communicate with the internal cavity of the basin.

2. The water pipe of claim 1, wherein the basin includes a bottom surface that defines a size and shape configured to render the water pipe free standing.

3. The water pipe of claim 1, wherein the lighter receptacle is sized to produce a frictional or interference fit with the handheld lighter.

4. The water pipe of claim 1, wherein the lighter receptacle is oriented to extend into the interior of the basin to position the handheld lighter at an angle of between 30 to 90 degrees from a bottom surface of the basin.

5. The water pipe of claim 1, wherein the lighter receptacle is located 90 degrees of rotation or less around a peripheral surface of the basin from the downstem receptacle and the bowl.

6. The water pipe of claim 1, wherein the lighter receptacle is formed integrally as a unitary piece with the basin.

7. The water pipe of claim 1, wherein a bottom end of the lighter receptacle at the closed bottom wall is positioned spaced apart from and above a bottom surface of the basin.

8. The water pipe of claim 1, wherein the lighter receptacle further comprises a removable dampening member configured to fit along an interior surface of the bottom wall of the lighter receptacle to absorb and dampen energy and shock to the lighter receptacle from storage and removal of the lighter.

9. A method of fabricating a water pipe comprising:

providing the water pipe with a chamber pipe in fluid communication and extending upwardly from a basin to a mouthpiece, wherein the basin defines an internal cavity;

forming a lighter receptacle proximate to the basin so as to be fixed in position relative to the basin wherein the lighter receptacle includes a rigid and seamless interior defined by a sidewall and a closed bottom wall;

forming the interior with a size configured to receive at a portion of a handheld lighter; and wherein the lighter receptacle retains the handheld lighter for storage at the water pipe in a location proximate to a bowl, wherein forming the lighter receptacle further comprises:

integrating the lighter receptacle with the basin so that the lighter receptacle extends into the internal cavity of the basin, but such that the interior of the lighter receptacle does not communicate with the internal cavity of the basin.

10. The method of claim 9, wherein a bottom end of the lighter receptacle at the closed bottom wall is positioned spaced apart from and above a bottom surface of the basin.

11. The method of claim 9, wherein integrating the lighter receptacle further comprises:

forming the lighter receptacle integrally as a unitary piece on the basin in a location proximate to the bowl.

12. The method of claim 9, further comprising:

orienting the lighter receptacle to position the handheld lighter at an angle of between 30 to 90 degrees from a horizontal bottom surface of the basin.

13. The method of claim 9, further comprising: positioning the lighter receptacle 90 degrees of rotation or less around a peripheral surface of the basin from a downstem receptacle and the bowl.

14. The method of claim 9, further comprising:

inserting a removable dampening member configured to fit along an interior surface of the bottom wall of the lighter receptacle.

15. The method of claim 9, further comprising:

forming the lighter receptacle such as to produce a frictional or interference fit with the handheld lighter.

16. A water pipe comprising:

a basin having an internal cavity;

a chamber pipe in fluid communication and extending upwardly from the basin to a mouthpiece, the mouthpiece being in communication with the internal cavity of the basin;

a bowl configured to hold a combustible material and mounted on a bowl stem that is removably engaged with at least one of a downstem and a downstem receptacle on a side of the basin; and a lighter receptacle proximate to the basin and fixed in position relative to the basin, wherein the lighter receptacle includes an open top, through which a handheld lighter may be received, and a rigid and seamless sidewall defined at least in part by a sidewall of the basin, and the lighter receptacle retains a handheld lighter for storage at the water pipe in a location proximate to the bowl, wherein the sidewall of the lighter receptacle is shaped to receive a portion of the handheld lighter having a corresponding shape.

* * * * *